US005114433A

United States Patent [19]

Dubreux et al.

[11] Patent Number: 5,114,433

[45] Date of Patent: * May 19, 1992

[54] DIRECTLY DISTILLED DIESEL FUELS HAVING IMPROVED CETANE NUMBERS

[75] Inventors: Bernard Dubreux, Francheville-le-Bas; Jacques Kervennal, Lyons; Philippe Mulard, Saint-Pierre-de-Chandieu; Michele Pralus, Saint-Cyr-au-Mont-d'Or, all of France

[73] Assignee: Atochem, Puteaux, France

[ * ] Notice: The portion of the term of this patent subsequent to May 19, 2009 has been disclaimed.

[21] Appl. No.: 493,461

[22] Filed: Mar. 14, 1990

[30] Foreign Application Priority Data

Mar. 14, 1989 [FR] France ..... 89 03576

[51] Int. Cl.[5] ..... C10L 1/04; C10L 5/00

[52] U.S. Cl. ..... 44/322; 208/15; 585/14; 44/385

[58] Field of Search ..... 44/57, 70, 77, 322, 44/385

[56] References Cited

U.S. PATENT DOCUMENTS

| | | | |
|---|---|---|---|
| 1,972,101 | 9/1934 | Malisoff | 196/26 |
| 2,092,322 | 9/1937 | Rudolf | 44/57 |
| 2,093,008 | 9/1937 | Egerton | 44/57 |
| 2,296,558 | 9/1942 | Kokutnur | 44/57 |
| 2,403,771 | 7/1946 | Vaughan | 44/57 |
| 2,403,772 | 7/1946 | Vaughan | 44/57 |
| 2,472,152 | 6/1949 | Furkas | 44/57 |
| 2,481,859 | 9/1949 | Miller | 44/57 |
| 2,912,313 | 11/1954 | Hinkamp | 44/57 |
| 3,035,904 | 5/1962 | Brown | 44/57 |
| 3,827,979 | 8/1974 | Piolrowski et al. | 44/57 |
| 4,248,182 | 2/1981 | Merlec | 44/57 |
| 4,286,969 | 9/1981 | Medcalf | 44/57 |
| 4,289,501 | 9/1981 | Medcalf | 44/57 |
| 4,406,254 | 9/1983 | Harris et al. | 44/57 |
| 4,474,579 | 10/1984 | Wilderson et al. | 44/57 |
| 4,482,352 | 11/1984 | Osgood | 44/57 |

FOREIGN PATENT DOCUMENTS 0237214 9/1987 European Pat. Off. .

*Primary Examiner*—Helane E. Myers

*Attorney, Agent, or Firm*—Burns, Doane, Swecker & Mathis

[57] ABSTRACT

The cetane numbers of directly distilled diesel fuels are significantly improved by intimately contacting same with an effective amount of hydrogen peroxide in the presence of a carboxylic acid, or with an effective amount of a percarboxylic acid either in the presence or absence of hydrogen peroxide.

12 Claims, No Drawings

DIRECTLY DISTILLED DIESEL FUELS HAVING IMPROVED CETANE NUMBERS

CROSS-REFERENCE TO COMPANION APPLICATION

Copending application, Ser. No. 07/475,348 filed Feb. 5, 1990 and assigned to the assignee hereof.

BACKGROUND OF THE INVENTION

1. Field of the Invention

The present invention relates to a process for improving the cetane number or index of the directly distilled diesel fuels.

2. Description of the Prior Art

The diesel fuels of direct distillation, or direct diesel fuels or diesel fuels proper, are median distillates, intermediate between light distillates, gas and gasolines and aviation fuels on the one hand, and the heavy residues on the other, produced by distillation at atmospheric pressure, at which the refining of crude oils begins. The composition and properties of the direct diesel fuels differentiate them in known manner from viscoreduction or catalytic cracking diesel fuels produced after distillation, under vacuum, of the aforementioned heavy residues. The distillation range under atmospheric pressure of a direct diesel fuel most typically ranges from about 150° C. -200° C. to about 350° C.-450° C.

The direct diesel fuels are essentially intended for use as fuels for diesel engines and as domestic heating fuels.

They must have a sufficiently high compression ignition rating, expressed by their cetane number, which is comparable to the octane number rating for gasoline.

The desirability of having available to industry such diesel fuels having a high cetane number has been recently described, for example in the European patent published under No. 0,252,606. Presently, cetane numbers higher than about 45, preferably higher than 50, are considered desirable.

One proposed solution to ensure a satisfactory cetane number for direct diesel fuels entails incorporating an additive therein. The disadvantage of such a technique is that the selection of the additive is restricted to one that is simultaneously relatively insoluble in water and chemically stable relative thereto, sufficiently soluble in the diesel fuel under the preferred conditions of use, stable in diesel fuel at all storage temperatures, and, finally, noncorrosive and nontoxic.

For a definition of the terms employed herein, such as motor diesel fuel, cetane number, etc., reference may be made to the following tests: *Le langage petrolier* (The language of petroleum), Gauthier-Villars, Paris (1964); *Le Petrole, raffinage et genie chimique* (Petroleum, refining and chemical engineering), edited by Pierre Wuithier, 2nd edition, Technip Publisher, pp. 16, 17, 29, 30 (1972), or the article by D. Indritz, "Preprints, Symposium of the Chemistry of Cetane Number Improvement", Miami Beach, Apr. 28-May 3, 1985, pp. 282-286.

The direct diesel fuels having an improved cetane index may be marketed in and of themselves or they may be admixed to increase the cetane index of diesel fuels having a lower cetane index.

SUMMARY OF THE INVENTION

A major object of the present invention is the provision of a process for improving the cetane number of a directly distilled diesel fuel by intimately contacting same with hydrogen peroxide in the presence of a carboxylic acid, or with a percarboxylic acid in the presence or absence of hydrogen peroxide.

DETAILED DESCRIPTION OF THE PREFERRED EMBODIMENTS OF THE INVENTION

More particularly according to the present invention, in the embodiment wherein the direct diesel fuel is intimately contacted with hydrogen peroxide in the presence of a carboxylic acid:

(i) the amount of hydrogen peroxide used per kg of the directly distilled diesel fuel, for reasons of safety and economy, is advantageously less than 300 g; most typically such amount does not exceed about 50 g;

(ii) the carboxylic acid, in actual practice, is advantageously selected from among formic acid, acetic acid and propionic acid; formic acid is the preferred. The molar ratio carboxylic acid/hydrogen peroxide preferably ranges from about 0.01 to 1 and even more preferably ranges from about 0.1 to 0.5;

(iii) the temperature at which the intimate contacting according to the invention is carried out advantageously ranges from about 50° to 100° C.;

(iv) the hydrogen peroxide may be employed in the form of an aqueous solution, containing, for example and most typically, from approximately 50% to 70% by weight of hydrogen peroxide;

(v) the duration of the contact time according to the invention depends on the other process parameters selected; preferably, it is sufficient, in combination with the other process parameters, to ensure the substantially complete disappearance or consumption of the hydrogen peroxide used; and (vi) the intimate contacting is carried out under agitation in a reactor resistant to acid corrosion and essentially equipped with an efficient agitator system, heating means and means to measure and control the temperature.

In the embodiment in which the direct diesel fuel is intimately contacted with a percarboxylic acid:

(i) the percarboxylic acid is advantageously selected, in actual practice, from among performic acid, peracetic acid and perpropionic acid. These are prepared in known manner, for example, relative to perpropionic acid, according to the processes described in the French applications published under Nos. 2,460,927, 2,464,947 and 2,519,634, respectively;

(ii) if the percarboxylic acid is used in the absence of hydrogen peroxide, it is employed in the same molar quantities as the hydrogen peroxide in the first embodiment described above;

(iii) if the percarboxylic acid is used in the presence of hydrogen peroxide, the cumulative molar quantities of the percarboxylic acid and the hydrogen peroxide are the same as those of the hydrogen peroxide used according to the first embodiment of the invention; and (iv) the temperature conditions, duration and other parameters for carrying out the process are the same as those for the first embodiment of the invention.

The process according to the invention is applicable to direct diesel fuels both prior to and after desulfurization, for example hydrodesulfurization, which reduces their sulfur content to a value corresponding to or lower than that required for the end use thereof. For example, it is applicable to a direct diesel fuel adapted for use as a diesel engine fuel.

The subject process presents the further advantage of not requiring any metal-based catalysts.

In order to further illustrate the present invention and the advantages thereof, the following specific examples are given, it being understood that same are intended only as illustrative and in nowise limitative. In said examples to follow, the cetane rating was determined according to ASTM Standard D-613.

EXAMPLE 1

Into an agitated 3 l reactor, 1,000 g of direct distillation diesel fuel and then 0.07 mole of formic acid were introduced. The agitated mixture was heated to 70° C. and was maintained at this temperature under agitation, first during the addition, over 1 hour, of 0.7 mole of hydrogen peroxide, introduced in the form of 34 g of an aqueous solution containing 70% by weight hydrogen peroxide, and then, for 5 additional hours, commencing from completion of the addition of the hydrogen peroxide.

The organic phase, subsequently separated by decantation of the mixture, permitted to rest and cooled, was washed such that the hydrogen peroxide and formic acid, which may have remained in the diesel fuel after treatment, was eliminated. Water was used for the washing operation.

The cetane rating of the initial direct distillation diesel fuel was equal to 58. That of the direct distillation diesel fuel after being subjected to the process according to the invention was 64.

An essentially like result was obtained when using one-half of the hydrogen peroxide employed above.

EXAMPLE 2

The procedure of Example 1 was repeated, but using a diesel engine fuel ready to use and having a cetane rating equal to 53. 0.7 Mole of hydrogen peroxide was used, per 1,000 g of such diesel fuel. The diesel fuel resulting from the treatment according to the invention then had a cetane rating equal to 57.5.

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims, including equivalents thereof.

What is claimed is:

1. A process for improving the cetane number of a directly distilled diesel fuel, comprising intimately contacting such directly distilled diesel fuel with an effective amount of hydrogen peroxide in the presence of formic acid, acetic acid or propionic acid, or with an effective amount of performic acid, peracetic acid or perpropionic acid either in the presence or absence of hydrogen perioxide.

2. The process as defined by claim 1, comprising intimately contacting said directly distilled diesel fuel with an effective amount of hydrogen perioxide in the presence of formic acid, acetic acid or propionic acid.

3. The process as defined by claim 1, comprising intimately contacting said directly distilled diesel fuel with an effective amount of performic acid, peracetic acid or perpropionic acid.

4. The process as defined by claim 3, comprising intimately contacting said directly distilled diesel fuel with an effective amount of performic acid, peracetic acid or perpropionic acid in the presence of hydrogen perioxide.

5. The process as defined by claim 3, comprising intimately contacting said directly distilled diesel fuel with an effective amount of performic acid, peracetic acid or perpropionic acid in the absence of hydrogen perioxide.

6. The process as defined by claim 2, wherein the effective amount of hydrogen peroxide is less than 300 g per kilogram of directly distilled diesel fuel.

7. The process as defined by claim 6, wherein the effective amount of hydrogen peroxide is no greater than 50 g per kilogram of directly distilled diesel fuel.

8. The process as defined by claim 2, wherein the molar ratio of acid to hydrogen peroxide ranges from about 0.01 to 1.

9. The process as defined by claim 8, said molar ratio ranging from 0.1 to 0.5.

10. The process as defined by claim 1, carried out at a temperature ranging from 50° to 10° C.

11. The process as defined by claim 1, carried out to such extent as to assure essentially complete disappearance of the hydrogen peroxide and/or percarboxylic acid.

12. The process as defined by claim 2, said hydrogen peroxide comprising an aqueous solution thereof.

* * * * *